US005578549A

United States Patent [19]

Burberry et al.

[11] Patent Number: 5,578,549

[45] Date of Patent: Nov. 26, 1996

[54] SINGLE-SHEET PROCESS FOR OBTAINING MULTICOLOR IMAGE USING DYE-CONTAINING BEADS

[75] Inventors: Mitchell S. Burberry; Lee W. Tutt, both of Webster, N.Y.

[73] Assignee: Eastman Kodak Company, Rochester, N.Y.

[21] Appl. No.: 576,518

[22] Filed: Dec. 21, 1995

[51] Int. Cl.[6] ..... B41M 5/035; B41M 5/38

[52] U.S. Cl. ..... 503/227; 428/195; 428/327; 428/913; 428/914; 430/200; 430/201; 430/945

[58] Field of Search ..... 8/471; 428/195, 428/327, 913, 914; 430/200, 201, 945; 503/227

[56] References Cited

U.S. PATENT DOCUMENTS 5,234,891 8/1993 Burberry et al. ..... 503/227

5,334,575 8/1994 Noonan et al. ..... 503/227

*Primary Examiner*—B. Hamilton Hess

*Attorney, Agent, or Firm*—Harold E. Cole

[57] ABSTRACT

This invention relates to a single-sheet process for obtaining a multicolor image comprising:

a) coating a support with a polymeric adhesion layer;

b) coating the adhesion layer with a single dye layer comprising a mixture of at least two different colors of solid, homogeneous beads, each of which contains an image dye, a binder and a laser light-absorbing material, the beads being dispersed in a vehicle, and the beads of each color being sensitized to a different wavelength;

c) exposing the element to laser light at the wavelength to which each type of bead is sensitized, causing the exposed beads to melt and become adhered to the polymeric adhesion layer; and d) removing any unadhered beads.

11 Claims, No Drawings

SINGLE-SHEET PROCESS FOR OBTAINING MULTICOLOR IMAGE USING DYE-CONTAINING BEADS

This invention relates to a single-sheet process for obtaining a multicolor image which employs an element containing at least two differently-colored dye-containing bead compositions which is exposed by a laser.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In U.S. Pat. Nos. 5,234,891 and 5,334,575, there is a disclosure of infrared-sensitized, colored beads which are used in a laser-induced thermal dye transfer process. However, there is a problem with that process in that a separate dye-donor element and a separate dye-receiving element are required. It is an object of this invention to provide a single-sheet process using dye-containing beads, which process utilizes only one element which would be cheaper and easier to employ.

This and other objects are achieved in accordance with this invention which relates to a single-sheet process for obtaining a multicolor image comprising:

a) coating a support with a polymeric adhesion layer;

b) coating the adhesion layer with a single dye layer comprising a mixture of at least two different colors of solid, homogeneous beads, each of which contains an image dye, a binder and a laser light-absorbing material, the beads being dispersed in a vehicle, and the beads of each color being sensitized to a different wavelength;

c) exposing the element to laser light at the wavelength to which each type of bead is sensitized, causing the exposed beads to melt and become adhered to the polymeric adhesion layer; and d) removing any unadhered beads.

The unadhered beads may be removed by washing with a nonsolvent for the beads such as water, using an air stream, or by laminating an adhesive-coated sheet, such as an adhesive tape, to the beads and removing the beads by peeling.

In another preferred embodiment of the invention, the element is heated after the removal step to further drive the dyes into the polymeric adhesion layer which improves the scratch resistance of the image. For example, temperatures of about 100° C. for about 30 seconds may be used, depending upon the Tg of the receiver polymer.

By use of this invention, full color reflection or transmission images can be achieved with low exposure with a single integral heat sensitive material. The process can be fully dry or use a simple aqueous wash to produce the final image.

The beads which contain the image dye, binder and laser light-absorbing material can be made by the process disclosed in U.S. Pat. No. 4,833,060, the disclosure of which is hereby incorporated by reference. The beads are described as being obtained by a technique called "evaporated limited coalescence."

The binders which may be employed in the solid, homogeneous beads of the invention which are mixed with the image dye and laser light-absorbing material include materials such as cellulose acetate propionate, cellulose acetate butyrate, poly(vinyl butyral), nitrocellulose, poly(styrene-co-butyl acrylate), polycarbonates such as Bisphenol A polycarbonate, poly(styrene-co-vinylphenol) and polyesters. In a preferred embodiment of the invention, the binder in the beads is cellulose acetate propionate or nitrocellulose. While any amount of binder may be employed in the beads which is effective for the intended purpose, good results have been obtained using amounts of up to about 50% by weight based on the total weight of the bead.

The vehicle in which the beads are dispersed to form the dye layer employed in the invention includes water-compatible materials such as poly(vinyl alcohol), pullulan, polyvinylpyrrolidone, gelatin, xanthan gum, latex polymers and acrylic polymers. In a preferred embodiment of the invention, the vehicle used to disperse the beads is gelatin or as poly(vinyl alcohol).

The beads are approximately 0.1 to about 20 μm in size, preferably about 1 μm. The beads can be employed at any concentration effective for the intended purpose. In general, the beads can be employed in a concentration of about 40 to about 90% by weight, based on the total coating weight of the bead-vehicle mixture.

Use of the invention provides a printing system that utilizes a random mixture of small, solid beads in a single layer to print images having excellent print density at relatively high printing speed and low laser power. This system is also capable of printing different colors from a single pass since the different colored beads are individually addressed by two or more lasers each having a wavelength tuned near the peak of the laser light-absorbing dye, i.e., 780 nm for the laser light-absorbing dye in the cyan beads, 875 nm for the laser light-absorbing dye in the magenta beads and 980 nm for the laser light-absorbing dye in the yellow beads.

There are numerous advantages in making a multicolor image by printing with only one single pass dye-donor. Using only one element results in less wasted support, fewer manufacturing steps, simpler finishing, simpler media handling in the printer, simpler quality assurance procedures and faster printing.

To obtain the laser-induced, multicolor, thermal dye image employed in the invention, diode lasers are preferably employed since they offer substantial advantages in terms of small size, low cost, stability, reliability, ruggedness, and ease of modulation. The beads must contain a laser light-absorbing material, such as carbon black or cyanine infrared-absorbing dyes as described in U.S. Pat. No. 4,973,572, or other materials as described in the following U.S. Pat. Nos. 4,948,777, 4,950,640, 4,950,639, 4,948,776, 4,948,778, 4,942,141, 4,952,552, 5,036,040, and 4,912,083, the disclosures of which are hereby incorporated by reference. The laser light-absorbing material can be employed at any concentration effective for the intended purpose. In general, good results have been obtained at a concentration of about 6 to about 25% by weight, based on the total weight of the bead. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. As noted above, the laser light-absorbing material is contained in the beads coated on the support.

Lasers which can be used in the process of the invention are available commercially. There can be employed, for example, Laser Model SDL-2420-H2 from Spectra Diode Labs, or Laser Model SLD 304 V/W from Sony Corp.

Any image dye can be used in the beads of the dye-donor employed in the invention. As noted above, a mixture of beads employing at least two different colors is used in order to give a multicolor transfer. In a preferred embodiment, cyan, magenta and yellow dyes are used in the beads. Especially good results have been obtained with sublimable dyes such as anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.); or any of the dyes disclosed in U.S. Pat. Nos. 4,541,830, 4,698,65 1, 4,695,287, 4,701,439, 4,757,046, 4,743,582, 4,769,360, and 4,753,922, the disclosures of which are hereby incorporated by reference. The above dyes may be employed singly or in combination. The image dye may be employed in the bead in any amount effective for the intended purpose. In general, good results have been obtained at a concentration of about 40 to about 90% by weight, based on the total weight of the bead.

Any material can be used as the support for the imaging element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimideamides and polyether-imides. The support can be transparent or reflective such as paper or resin-coated paper. The support generally has a thickness of from about 5 to about 200 μm.

The polymeric adhesion layer employed in the invention can be the same material as used in the binder for the beads, such as cellulose acetate propionate, cellulose acetate butyrate, poly(vinyl butyral), nitrocellulose, poly(styrene-co-butyl acrylate), polycarbonates such as Bisphenol A polycarbonate, poly(styrene-covinylphenol) and polyesters. In a preferred embodiment of the invention, the polymeric adhesion layer is poly(vinyl butyral). The coverage of this layer can be, for example, from about 0.1 to about 10 g/m$^2$.

The following examples are provided to illustrate the invention.

EXAMPLE 1

Preparation of Bead Dispersions

A combination of a polymeric binder as described below, image dye, and laser light-absorbing dye were dissolved in dichloromethane (or methylisopropyl ketone where indicated). A mixture of 30 ml of Ludox® $SiO_2$ (DuPont) and 3.3 ml of a 10% aqueous solution of a copolymer of methylaminoethanol and adipic acid (Eastman Kodak Co.) was added to 1000 ml of phthalic acid buffer (pH 4). The organic and aqueous phases were mixed together under high shear conditions using a microfluidizer. The organic solvent was then distilled from the resulting emulsion by distillation using a rotavaporizer. This procedure resulted in an aqueous dispersion of solid beads in a water phase and the particles were isolated by centrifugation. The isolated wet particles were put into distilled water at a concentration of approximately 10 wt. %.

The following dyes were used in the experiments as described below:

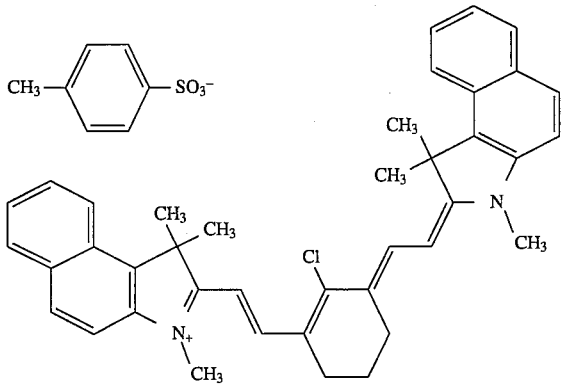
IR-1 IR-Absorbing Dye
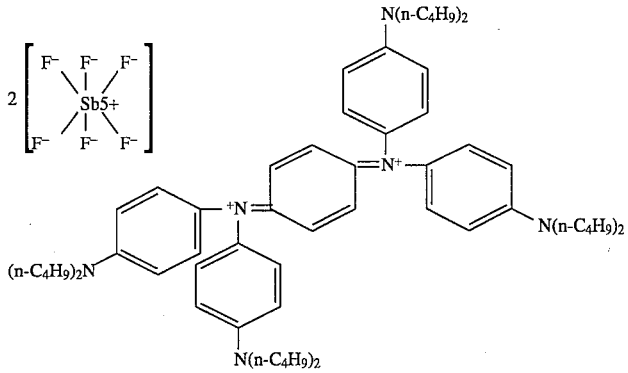
IR-2 IR-Absorbing Dye
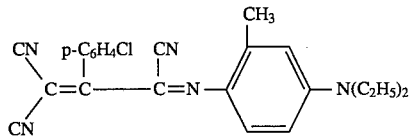
C-1 Cyan Dye
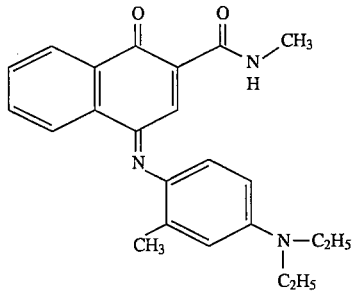
C-2 Cyan Dye
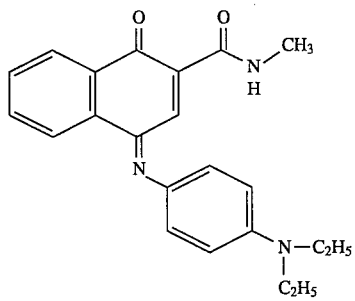
C-3 Cyan Dye -continued

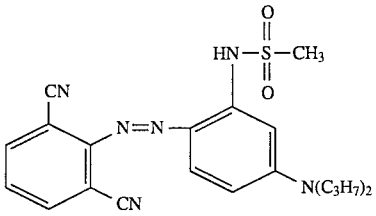

M-1 Magenta Dye

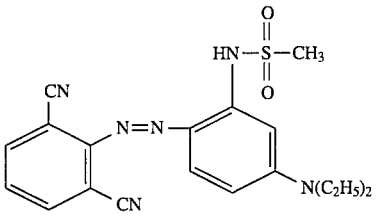

M-2 Magenta Dye

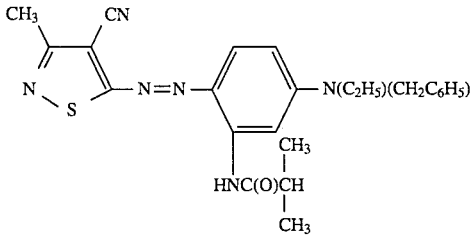

M-3 Magenta Dye

Cyan beads of approximately 3 μm diameter were prepared according to the "evaporated limited coalescence technique" as described in U.S. Pat. No. 4,833,060 and applied in the aforementioned U.S. Pat. No. 5,344,575. The following ingredients were used in the amounts (in g) indicated:

| | |
|---|---|
| CAP-5 cellulose acetate propionate (Eastman Chemicals Co.) 0.5 sec viscosity | 4 |
| IR-1 | 1.5 |
| C-1 | 1 |
| C-2 | 0.8 |
| C-3 | 0.5 |
| DCM (dichloromethane) solvent | 50 |
| Ludox ® $SiO_2$ (DuPont) | 3 |
| 10% aqueous solution of a copolymer of methylamino-methanol and adipic acid (Eastman Kodak Co.) | 0.3 |
| Phthalic acid pH 4 buffer | 250 |

Similarly prepared were magenta beads of approximately 3 μm diameter using the following amounts (in g):

| | |
|---|---|
| CAP-5 | 4 |
| IR-2 | 0.7 |
| M-1 | 1 |
| M-2 | 0.5 |
| M-3 | 1 |
| DCM (dichloromethane) solvent | 50 |
| Ludox ® $SiO_2$ | 3 |
| 10% aqueous solution of a copolymer of methylamino-methanol and adipic acid (Eastman Kodak Co.) | 0.3 |
| Phthalic acid pH 4 buffer | 250 |

A 100 μm poly(ethylene terephthalate) film support was coated with 1.08 g/m$^2$ poly(vinyl butyral) and a dye bead layer containing the above cyan and magenta beads in a 3:1 mixture in poly(vinyl alcohol) plus Dowfax® (a surfactant from Dow Chemical Co.) was coated onto the so-prepared support at final laydowns of ~3.23 g/m$^2$, 0.54 g/m$^2$, and 0.11 g/m$^2$, respectively.

Samples of the above prepared film were exposed using a laser diode print head where each laser beam had a wavelength range of 830–840 nm and a nominal output of 600 mW at the film plane. The print drum of 53 cm circumference was rotated at varying speeds and the in, aging electronics were activated to provide adequate exposure. The translation stage was incrementally advanced across the bead-carrying film by means of a lead screw turned by a microstepping motor to provide a center-center line distance of 10.58 μm (945 lines per centimeter or 2400 lines per inch). The material was placed support side out over a piece of Approval® Intermediate Receiver (Eastman Kodak Co.) which is a polyester support overcoated with binder and large beads. It was used to protect the drum from excess dye. The exposure was ~1.2 J/cm$^2$.

The film was also exposed at 1064 nm using a 6 Watt NdYAG laser system. The drum was smaller (39.4 cm) than previously but the experiment was otherwise conducted identically. The drum rotation was 600 rpm with a 60 μm line spacing. The exposure at the film plane was ~2.5 J/cm$^2$.

Upon exposure the material was subjected to a light stream of water, which gently removed all colored beads that had not been exposed or did not absorb at the written wavelength. A color change was distinctly apparent. The color differentiation was measured, using an X-Rite 351T densitometer (X-Rite Corp., Grandville, Mich. The results were as follows:

TABLE 1

| | Green minus Red Status A Density | Green Status A Density | Red Status A Density |
|---|---|---|---|
| Exposure Wavelength (nm) | Magenta-Cyan | Magenta | Cyan |
| no laser (Dmin) | 0.00 | 0.03 | 0.03 |

TABLE 1-continued

| | Green minus Red Status A Density | Green Status A Density | Red Status A Density |
|---|---|---|---|
| 830 | 0.12 | 1.45 | 1.33 |
| 1064 | 0.41 | 1.53 | 1.12 |
| 830 & 1064 | 0.35 | 1.71 | 1.36 |

It is seen that the Dmin achieved is good since all beads were removed by the aqueous rinse. The Status A Green Density is a measure of the adhered magenta beads. The Status A Red Density is a measure of the adhered cyan beads. Many more magenta beads adhered to the receiver layer when exposed to 1064 nm than adhered with an 830 nm exposure, as evidenced by the 0.41 magenta-cyan optical absorption compared to 0.12. This means that different colors can be created as desired, depending on the wavelength used to expose the film.

EXAMPLE 2

On a 1.08 g/m$^2$ layer of poly(vinyl butyral) on 100 μm Estar® poly(ethylene terephthalate) was coated a mixture of magenta and cyan beads in poly(vinyl alcohol) with a small amount of 10G surfactant (from Olin Corp.). A laydown of 0.54 g/m$^2$ of beads was obtained.

The film was exposed as in Example 1.

Scotch Magic Transparent tape (available from 3M Corp.) was applied to the exposed and unexposed regions and then removed by peeling. The density results are listed below:

TABLE 2

| | Green Status A Density | Red Status A Density |
|---|---|---|
| Exposure Wavelength (nm) | Magenta | Cyan |
| no laser (Dmin) | 0.03 | 0.04 |
| 830 | 0.05 | 0.09 |
| 1064 | 0.07 | 0.04 |
| 830 & 1064 | 0.10 | 0.11 |

These results show that the two differently colored laser beams individually address different beads and cause different colors to be generated. The lamination/peel steps remove all beads which have not been melted. Exposure with 830 nm yields predominately cyan color. Exposure with 1064 nm yields predominately magenta color. Exposure simultaneously with both 830 nm and 1064 nm yields a mixture of both colors.

The invention has been described in detail with particular reference to preferred embodiments thereof, but it will be understood that variations and modifications can be effected within the spirit and scope of the invention.

What is claimed is:

1. A single-sheet process for obtaining a multicolor image comprising:

a) coating a support with a polymeric adhesion layer;

b) coating said adhesion layer with a single dye layer comprising a mixture of at least two different colors of solid, homogeneous beads, each of which contains an image dye, a binder and a laser light-absorbing material, said beads being dispersed in a vehicle, and said beads of each color being sensitized to a different wavelength;

c) exposing said element to laser light at the wavelength to which each type of bead is sensitized, causing said exposed beads to melt and become adhered to said polymeric adhesion layer; and d) removing any unadhered beads.

2. The process of claim 1 wherein said step d) is a water wash.

3. The process of claim 1 wherein said step d) is accomplished by laminating an adhesive-coated sheet to the beads and removing the beads by peeling.

4. The process of claim 1 wherein said element after step d) is heated to further drive said dyes into said polymeric adhesion layer.

5. The process of claim 1 wherein said vehicle is gelatin.

6. The process of claim 1 wherein said vehicle is poly(vinyl alcohol).

7. The process of claim 1 wherein said binder is cellulose acetate propionate or nitrocellulose.

8. The process of claim 1 wherein said beads are approximately 0.1 to about 20 μm in size.

9. The process of claim 1 wherein said beads are employed at a concentration of about 40 to about 90% by weight, based on the total coating weight of the bead-vehicle mixture.

10. The process of claim 1 wherein each said laser fight-absorbing material is a dye.

11. The process of claim 1 wherein said polymeric adhesion layer is poly(vinyl butyral).

* * * * *